US009745117B2

(12) United States Patent
Kim et al.

(10) Patent No.: US 9,745,117 B2
(45) Date of Patent: Aug. 29, 2017

(54) DISPENSER CONTAINER COMPRISING SAFETY BUTTON STRUCTURE

(71) Applicant: YONWOO CO., LTD., Incheon (KR)

(72) Inventors: You-Seob Kim, Incheon (KR); Seo-Hui Jung, Incheon (KR)

(73) Assignee: YONWOO CO., LTD., Incheon (KR)

( * ) Notice: Subject to any disclaimer, the term of this patent is extended or adjusted under 35 U.S.C. 154(b) by 151 days.

(21) Appl. No.: 14/427,009

(22) PCT Filed: Oct. 29, 2012

(86) PCT No.: PCT/KR2012/008925
§ 371 (c)(1),
(2) Date: Mar. 10, 2015

(87) PCT Pub. No.: WO2014/042309
PCT Pub. Date: Mar. 20, 2014

(65) Prior Publication Data

US 2015/0239643 A1 Aug. 27, 2015

(30) Foreign Application Priority Data

Sep. 11, 2012 (KR) ..... 10-2012-0100597

(51) Int. Cl.
*B67B 1/00* (2006.01)
*B65D 83/22* (2006.01)
(Continued)

(52) U.S. Cl.
CPC ..... *B65D 83/222* (2013.01); *B05B 11/3023* (2013.01); *B05B 11/3059* (2013.01);
(Continued)

(58) Field of Classification Search
CPC ..... B65D 83/222; B65D 83/20; B65D 83/16; B05B 11/3023; B05B 11/3059; B05B 11/3074
(Continued)

(56) References Cited

U.S. PATENT DOCUMENTS 3,422,996 A * 1/1969 Lipman ..... B05B 11/3059 222/384
3,460,719 A * 8/1969 O'Donnell ..... B65D 83/205 222/320
(Continued)

FOREIGN PATENT DOCUMENTS

JP 10-061544 A 3/1998
JP 2005-230800 A 9/2005
(Continued)

OTHER PUBLICATIONS

International Search Report issued in PCT/KR2012/008925 dated Mar. 14, 2013.

*Primary Examiner* — Patrick M Buechner
*Assistant Examiner* — Michael J Melaragno
(74) *Attorney, Agent, or Firm* — Marshall, Gerstein & Borun LLP

(57) ABSTRACT

The present invention relates to a dispenser container comprising safety button structure. The dispenser container comprising safety button structure according to the present invention is designed such that a button member goes up and down, thereby allowing the contents to be discharged by pumping of a pumping member only when a rotating body is rotated, and thus it is possible to fundamentally prevent a button member from being pressed by children with poor cognition. Therefore, it is possible to prevent children from taking in harmful substances into the body and prevent unnecessary waste of contents.

3 Claims, 4 Drawing Sheets

(51) Int. Cl.
*B65D 83/20* (2006.01)
*B05B 11/00* (2006.01)

(52) U.S. Cl.
CPC ..... *B05B 11/3074* (2013.01); *B65D 83/20* (2013.01); *B05B 11/0048* (2013.01)

(58) Field of Classification Search
USPC ..... 222/153.13, 153.14; 251/100
See application file for complete search history.

(56) References Cited

U.S. PATENT DOCUMENTS 3,570,723 A * 3/1971 Kotuby ..... B65D 83/205 222/402.13
3,632,024 A * 1/1972 Usen ..... B65D 83/205 222/402.11
3,721,423 A * 3/1973 Shay ..... B65D 83/205 222/402.11
3,828,982 A * 8/1974 Steigerwald ..... B65D 50/045 222/153.11
3,937,368 A * 2/1976 Hoagland ..... B65D 83/205 222/402.11
4,024,988 A * 5/1977 Starrett ..... B65D 50/06 222/153.11
4,065,036 A * 12/1977 Kirk, Jr. ..... B05B 11/3059 222/153.13
4,369,899 A * 1/1983 Magers ..... B67D 7/0211 222/153.13
4,848,595 A * 7/1989 Foster ..... B67D 7/0211 222/153.13
4,865,228 A * 9/1989 Landecker ..... B05B 11/3059 222/153.13
5,000,347 A * 3/1991 Tran ..... B05B 11/3059 222/1
5,224,854 A * 7/1993 Ansquer ..... F23Q 2/46 222/153.09
5,335,830 A * 8/1994 Cater ..... B05B 11/3023 222/153.13
5,411,185 A * 5/1995 Drobish ..... B05B 1/1645 222/402.17
5,417,563 A * 5/1995 Cirami ..... F23Q 2/164 222/153.01
5,615,806 A * 4/1997 Grothoff ..... B05B 11/3023 222/153.13
5,772,080 A * 6/1998 de Pous ..... B05B 11/3049 222/153.13
5,899,363 A * 5/1999 Bliss, III ..... B05B 11/0029 222/153.02
5,918,780 A * 7/1999 Tanaka ..... B65D 83/20 222/402.1
5,971,230 A * 10/1999 Tanaka ..... B65D 83/205 222/402.1
6,045,008 A * 4/2000 Gonzalez Fernandez ..... B05B 11/3023 222/153.13
6,601,735 B2 * 8/2003 Milian ..... B05B 11/0027 222/153.11
6,932,244 B2 * 8/2005 Meshberg ..... B05B 11/0032 222/153.13
8,127,968 B2 * 3/2012 Yerby ..... B65D 83/206 222/153.11
8,857,671 B2 * 10/2014 Muller ..... B05B 11/3052 222/321.9
2003/0150876 A1 * 8/2003 Walters ..... B05B 11/3059 222/153.13
2005/0121474 A1 * 6/2005 Lasserre ..... B65D 83/44 222/402.1
2006/0113327 A1 * 6/2006 Walters ..... B05B 11/3014 222/153.11
2006/0113329 A1 * 6/2006 Walters ..... B05B 11/3014 222/383.1
2007/0246484 A1 * 10/2007 Yoshida ..... B05B 11/3059 222/153.13
2008/0083783 A1 * 4/2008 Nelson ..... B05B 11/3087 222/153.13
2008/0083784 A1 * 4/2008 Foster ..... B05B 11/3087 222/153.13
2008/0217359 A1 * 9/2008 Bougamont ..... B05B 11/3059 222/153.13
2009/0218369 A1 * 9/2009 Carnacina ..... B05B 11/3049 222/153.11
2010/0116849 A1 * 5/2010 Lautre ..... B05B 11/0029 222/153.13
2011/0297700 A1 * 12/2011 Santagiuliana ..... B05B 11/3001 222/153.13
2013/0200106 A1 * 8/2013 Kang ..... B65D 55/02 222/153.13
2014/0144943 A1 * 5/2014 Kim ..... B05B 11/3097 222/153.13
2015/0108171 A1 * 4/2015 Kim ..... B05B 11/3001 222/321.3
2015/0239643 A1 * 8/2015 Kim ..... B05B 11/3023 222/153.14
2015/0257510 A1 * 9/2015 Kim ..... A45D 34/041 401/126
2015/0342411 A1 * 12/2015 Son ..... B05B 11/0081 366/130
2015/0367367 A1 * 12/2015 Lefevre ..... B65D 50/065 222/153.13

FOREIGN PATENT DOCUMENTS

JP 2009-543742 A 12/2009
KR 20-0439761 Y1 5/2008

* cited by examiner

[Fig. 1]
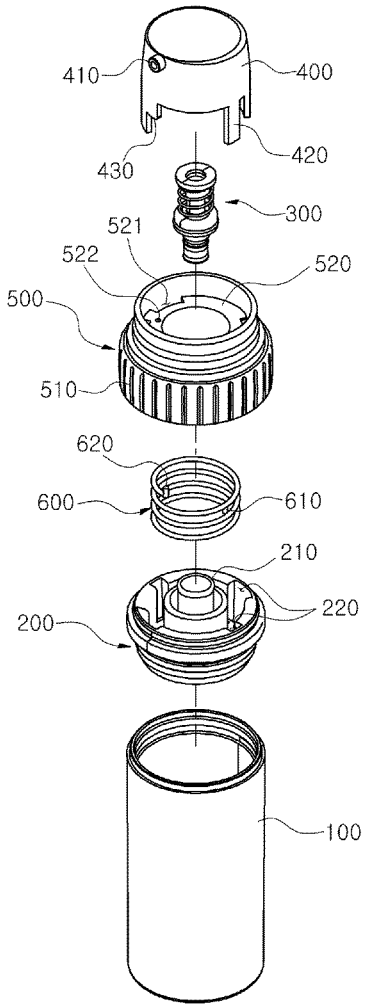

[Fig. 2]
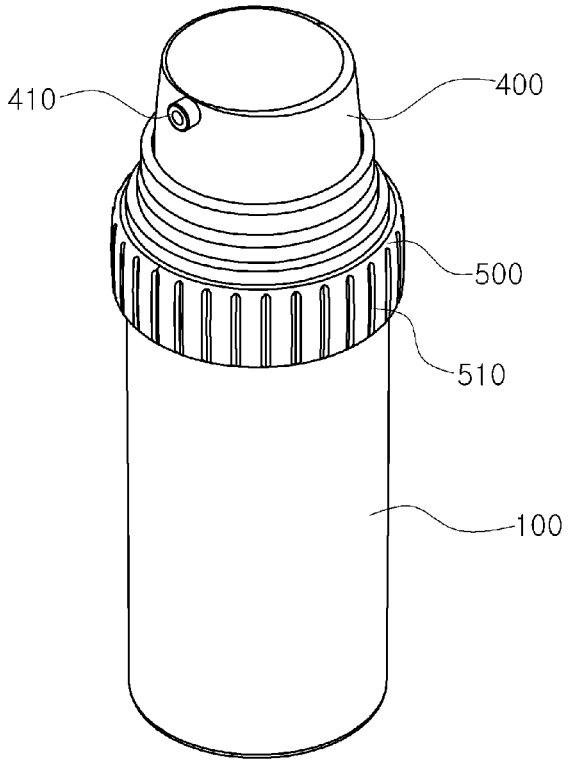

[Fig. 3]
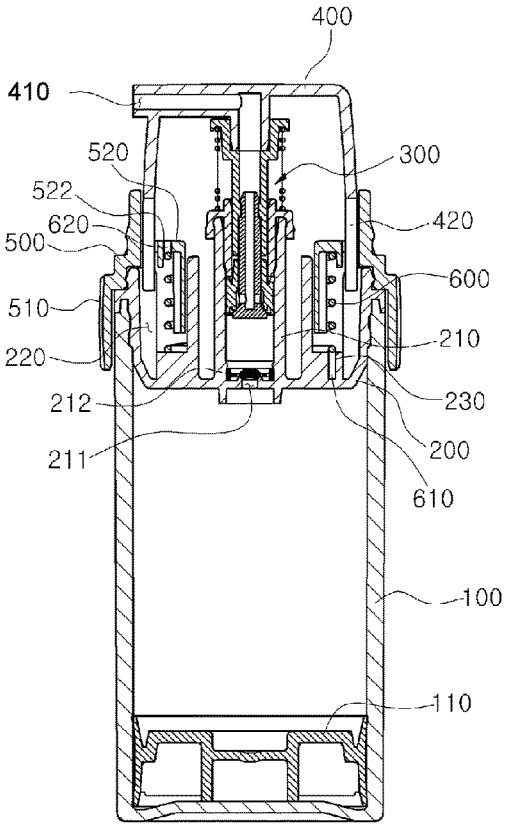
[Fig. 4]
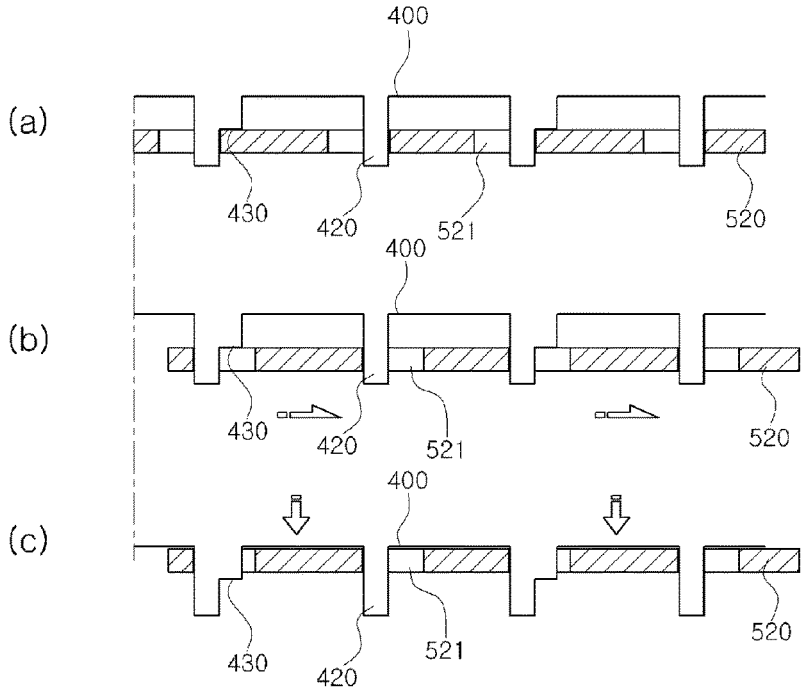

[Fig. 5]
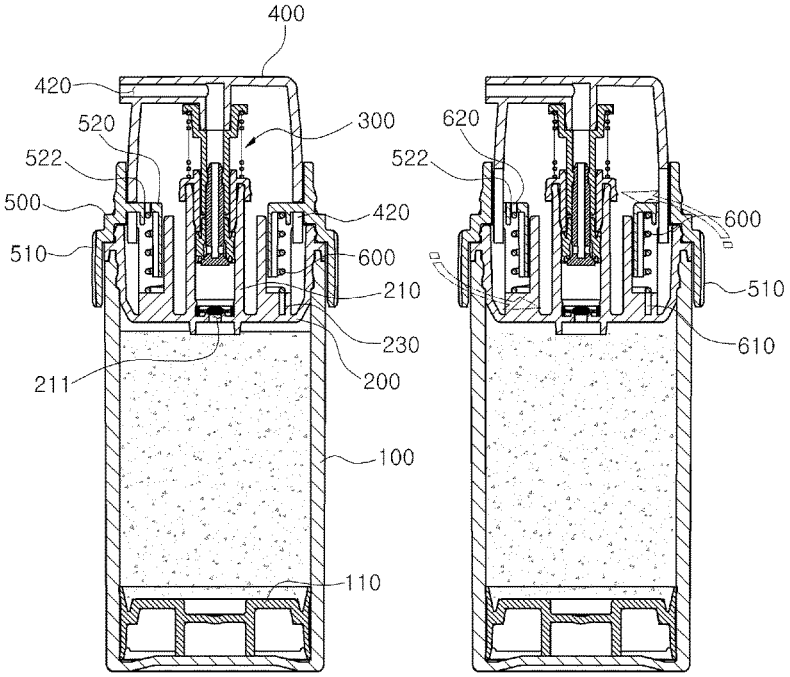
[Fig. 6]
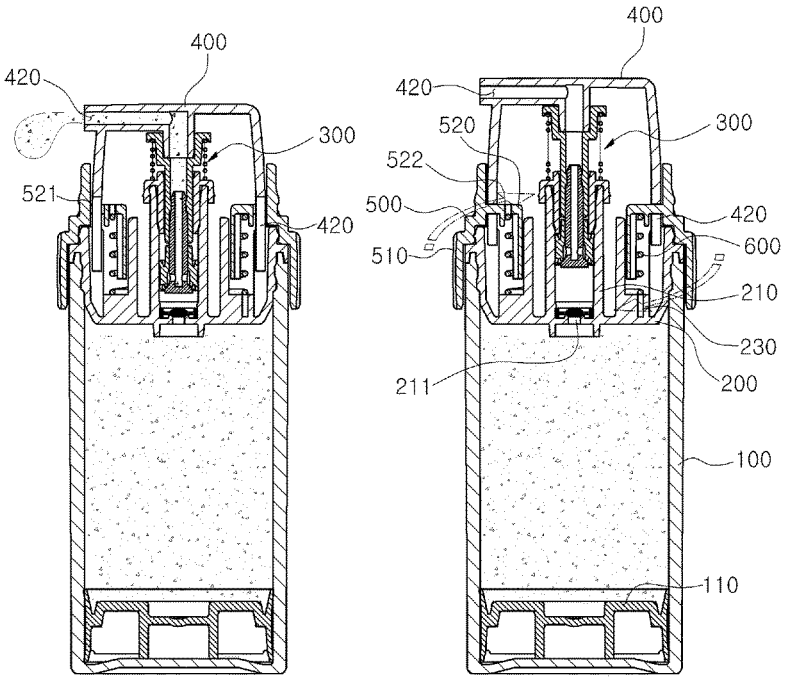

DISPENSER CONTAINER COMPRISING SAFETY BUTTON STRUCTURE

CROSS-REFERENCE TO RELATED APPLICATIONS

This U.S. non-provisional patent application is a national stage application under 35 U.S.C. §371 of international application PCT/KR2012/008925, filed Oct. 29, 2012, and claims the benefit of priority under 35 U.S.C. §119 of Korean Patent Application No. 10-2012-0100597, filed Sep. 11, 2012, the entire content of which is hereby incorporated by reference for all purposes.

BACKGROUND

The present disclosure relates to a dispenser container comprising safety button structure. The dispenser container comprising safety button structure according to the present disclosure is designed such that a button member goes up and down, thereby allowing the contents to be discharged by pumping of a pumping member only when a rotating body is rotated, and thus it is possible to fundamentally prevent a button member from being pressed by children with poor cognition. Therefore, it is possible to prevent children from ingesting harmful substances into the body and prevent unnecessary waste of contents.

Generally, a dispenser is an apparatus that is coupled on the upper part of the vacuum-sealed container filled with gas, liquid or other contents, and discharges contents from the containers quantitatively by pressurizing, thereby being utilized in all kinds of vacuum-sealed containers for holding cosmetics, medicines, or food.

This type of containers comprises a container body that holds contents; a pumping member that is coupled to the upper part of the container body and makes the inside of the container vacuumed and draws up the contents by pumping; and a button member that is mounted on the upper part of the pumping member and goes up and down by pressurization of a user, delivering pressure to the pumping member, wherein by the button member being pressed, pumping is performed and contents are discharged; on the other hand, when the container is carried in a portable bag, there may arise a problem wherein, without the user's intention, the button may be pressed and thereby unnecessary spill of the contents may be caused.

Furthermore, children who have low cognitive ability may press the button member and expensive contents may be spilled out, so that it is possible that not only are contents wasted but also a risk for children to ingest contents may arise.

Accordingly, to solve the above problem, it is needed that pressing the button member should be limited, or a variety of locking measures for preventing pumping of the pumping member are needed.

SUMMARY OF THE DISCLOSURE

The present disclosure is devised to solve the said problems above, and its goal is to provide a dispenser container comprising safety button structure, wherein a button member goes up and down only when a rotation body is rotated and thereby contents can be discharged by pumping of the pumping member; therefore, it is possible to fundamentally prevent the button member from being pressurized by children who have low cognitive ability, and thus not only to prevent children from ingesting harmful substances but also to prevent content from unnecessarily being wasted.

Furthermore, it is to provide a dispenser container comprising safety button structure which can prevent content from unnecessarily being wasted by a user's pressurizing the button member unintentionally while carrying the container in a portable bag.

To solve the problems above, according to the present disclosure, a dispenser container comprising safety button structure comprises a container body which contains contents; a support body which is coupled to the upper part of the container body and supports a pumping member; a pumping member which is coupled to the support body and discharges contents by pumping; a button member which is coupled on the upper part of the pumping member and goes up and down by the presence of a user's pressurization and delivers pressure to the pumping member; a rotation body which encircles the support body on the upper part of the container body and is coupled so as to be rotated, while limits pressing action of the button member alternatively by rotation to one direction or to the other; and a restoring spring, whose one end is fixed to the support body and whose other end is fixed to the rotation body, and thus restores the rotation body which is rotated to one direction.

In addition, it is featured that on the inner surface of the rotation body is provided a lifting limiting plate which limits the ascent/descent of the button member according to the presence of the rotation of the rotation body, and that on the lifting limiting plate is provided pumping guide grooves which guide the ascent/descent of the button member only when the rotation body is rotated to one direction.

In addition, it is featured that on the lower end of button member is provided a torsion prevention protrusion that prevents torsion when the button member goes up and down.

In addition, it is featured that on the support body is provided a vertical guide groove, wherein a pumping preventing protrusion and a torsion preventing protrusion are inserted respectively on the lower end of the support body and guides the pumping preventing protrusion and the torsion preventing protrusion to move vertically.

In addition, it is featured that a $1^{st}$ fixing groove is provided on the support body for one end of the restoring spring to be inserted and fixed, and that a $2^{nd}$ fixing groove is provided on the rotation body for the other end of the restoring spring to be inserted and fixed.

As described above, according to the present disclosure, a button member is designed to go up and down only when the rotation body is rotated, thereby allowing contents to be discharged by pumping of a pumping member, and thus it is possible to fundamentally prevent a button member from being pressurized by children with poor cognitive ability. Therefore, it is possible to prevent children from ingesting harmful substances into the body and prevent unnecessary waste of contents.

In addition, when the container is carried in a portable bag, it is possible to prevent unnecessary spill of contents, which may be caused by a user's unintended pressurization of the button

BRIEF DESCRIPTION OF THE DRAWINGS

FIG. 1 is an exploded perspective view illustrating a configuration of a dispenser container comprising safety button structure according to an exemplary embodiment of the present disclosure;

FIG. 2 is an assembled perspective view illustrating a configuration of a dispenser container comprising safety button structure according to an exemplary embodiment of the present disclosure;

FIG. 3 is a cross-sectional view illustrating a configuration of a dispenser container comprising safety button structure according to an exemplary embodiment of the present disclosure;

FIG. 4 is an explanatory view illustrating a configuration of ascending/descending operational process of a button member by the rotation of a rotation body of a dispenser container comprising safety button structure according to an exemplary embodiment of the present disclosure;

FIG. 5 and FIG. 6 is an explanatory view illustrating a method of use of a dispenser container comprising safety button structure according to an exemplary embodiment of the present disclosure.

DETAILED DESCRIPTION

Hereinafter, exemplary embodiments of the present disclosure will be described in detail with reference to the accompanying drawings. The same reference numerals provided in the drawings indicate the same members.

FIG. 1 is an exploded perspective view illustrating a configuration of a dispenser container comprising safety button structure according to an exemplary embodiment of the present disclosure; FIG. 2 is an assembled perspective view illustrating a configuration of a dispenser container comprising safety button structure according to an exemplary embodiment of the present disclosure.

FIG. 3 is a cross-sectional view illustrating a configuration of a dispenser container comprising safety button structure according to an exemplary embodiment of the present disclosure; and FIG. 4 is an explanatory view illustrating a configuration of ascending/descending operational process of a button member by the rotation of a rotation body of a dispenser container comprising safety button structure according to an exemplary embodiment of the present disclosure.

Referring to FIGS. 1 to 4, a dispenser container comprising safety button structure according to an exemplary embodiment of the present disclosure includes a container body 100, a support body 200, a pumping member 300, a button member 400, a rotation body 500, and a restoring spring 600.

The said container body 100 holds contents, wherein the upper end of the container body 100 is closed by coupling with a support body 200 which will be mentioned later, and inside the container body 100, is coupled with a piston 110 which goes up according to the use of contents.

The said support body 200 is coupled to the upper part of the container body 100 and supports a pumping member 300, wherein on the middle of the support body, a pump combining tube 210, coupled with the pumping member 300 and forming space for making pumping possible, is combined with protrusion upwards, wherein on the middle of the lower end of the pump combining tube 210, a content suction hole 211 is coupled so as to make the contents held in the container body 100 move up to the upper part, and wherein a check valve 212 is coupled on the content suction hole 211 so as to prevent reflux of the contents that flows in.

Regarding to the present disclosure, it is featured that on the inner surface of the support body 200 is provided a vertical guide groove 220, which has a torsion preventing protrusion 420 and a pumping preventing protrusion 430 inserted respectively and guides the torsion preventing protrusion 420 and the pumping preventing protrusion 430 to move to the vertical direction; thus a vertical guide groove 220 leads a multitude of vertical guide grooves 220 that are formed with a set distance apart along the inner circumferential surface of the support body 200 to guide the vertical movement of the torsion preventing protrusion 420 and the pumping preventing protrusion 430, thereby preventing the torsion of the button member 400 when the button member 400 goes up and down.

Meanwhile, it is featured that on the end of the inner surface of the support body 200 a $1^{st}$ fixing groove 230 is provided so that one end of a restoring spring 600 which will be mentioned later is inserted and fixed, wherein a $1^{st}$ bent part 610 that is bent downwards is inserted into the $1^{st}$ fixing groove 230 and fixes one end of the restoring spring 600 into the support body 200, working on with a $2^{nd}$ bent part 620 which is inserted and fixed into a $2^{nd}$ fixing groove 522 and accumulating elastic energy when the rotation body 500 is rotated, and then restoring the rotation body by recoiling force of a coiled spring when the rotation body 500 is stopped rotating.

The said pumping member 300 is coupled to a pump combining tube 210 of the said support body 200, and when the button member 400 is pressurized, discharges contents to the outside; herein, the pumping member 300 is a prior art in the field of technology where this invention belongs to, and thus detailed explanation is omitted.

The said button member 400 is coupled to the upper part of the pumping member 300, going up and down according to the presence or absence of a user's pressurization, and delivers the pressure to the pumping member 300, and thus makes pumping possible, wherein a discharging hole 410 is provided on the side surface of the pumping member 300 to allow contents to be discharged by pumping.

On the lower end of the said button member 400 are provided a multitude of torsion prevention protrusions 420 set with regular distance apart to prevent torsion when the button member 400 goes up and down, wherein the torsion prevention protrusions 420 move along the vertical guide groove 220 formed on the inner circumferential surface of the support body 200, and thus are able to move vertically without being tilted to either side.

In addition, on the lower end of the button member 400 is provided a pumping preventing protrusion that is secured on the upper end of the lift limiting plate 520 and prevents the button member 400 from going up and down, wherein the pumping preventing protrusion 430, shown in FIG. 4, is secured on the upper end of the lift limiting plate 520 of the rotation body 500 when in the normal state, and thereof prevents the button member 400 from being pressurized, whereas when the rotation body 500 is rotated and is located directly above the pumping guide groove 521, the pumping preventing protrusion 430 moves downwards along the pumping guide grooves 521 and causes the button member 400 to go up and down.

In addition, it is preferred that the pumping preventing protrusion 430 moves along a vertical guide groove 220 of the support body 200, and thus prevents torsion phenomenon of the button member 400, not to be tiled to one side, neither to the left nor to the right.

It is characterized that the said rotation body 500 encircles the support body 200 on the upper part of the container body 100, and is coupled to be able to rotate, wherein the rotation body 500 in the present disclosure limits selectively the pressing operation of the button member 400 by the rotation of either one end or the other end of the rotation body 500. To make this operation possible, on the inner surface of the rotation body 500 is provided a lift limiting plate 520 which limits the ascent/descent of the button member 400 according to the presence or absence of the rotation of the rotation body 500, wherein a pumping guide groove 521 guiding the button member 400 to go up and down only when the rotation body 500 rotates to one direction is provided on the lift limiting plate 520.

The said pumping guide groove 521 is provided in numbers on the a lift limiting plate 520 with a set distance apart so as for the torsion preventing protrusion 420 and the pumping preventing protrusion 430 to move.

On the other hand, it is characterized that a 2nd fixing groove 522 is provided on the rotation body 500 so that the other end of a restoring spring 600 that will be mentioned may be inserted and fixed, wherein on the 2nd fixing groove 522, the 2nd bent part 620 that is bent in upward direction is inserted and fixes one end of the restoring spring 600 to the lift limiting plate 520, and then is inserted when the rotation body 500 is rotated, thereby accumulating elastic energy as operating with the $1^{st}$ bent part 610, and when the rotation body 500 stopped rotating and is released, restoring the rotation body 500 by recoiling force of a coiled spring.

On the other hand, it is preferred that a torsion preventing protrusion 420 is provided on the outer circumferential surface of the rotation body 500 so as for a user to rotate easily when trying to rotate while pressurizing.

One end of the said restoring spring 600 is fixed to the support body 200 while the other end of the restoring spring 600 is the rotation body 500 and restores the rotation body 500 rotated to one direction, wherein one end of the restoring spring 600 forms the $1^{st}$ bent part 610 that is bent to downward direction on the lower end of the restoring spring 600, whereas the other end of the restoring spring 600 forms the $2^{nd}$ bent part 620 that is bent to upward direction on the upper end of the restoring spring 600.

The said restoring spring 600 has a structure where the $1^{st}$ bent part 610 and the $2^{nd}$ bent part 620 are inserted into the $1^{st}$ fixing groove 230 of the support body 200 and into the $2^{nd}$ fixing groove 522 respectively, so that the restoring spring 600 accumulates elastic energy when the rotation body 500 is rotated to one direction, and then supplies the elastic energy so as for the rotation body 500 to rotate to the other direction and to be restored when the rotation body 500 is made to stop rotating and to be released.

The said restoring spring 600 enables the rotation body 500 to be restored automatically by stopping the rotation of the rotation body 500 and releasing the rotation body 500, and thereby prevents the button member 400 from not being pressurized, so that a user do not need to restore the rotation body 500 to the other direction each time, and user convenience will be provided.

In the following, referring to FIG. 4 to FIG. 6, a method of use of a dispenser container comprising safety button structure according to an exemplary embodiment of the present disclosure is explained. FIG. 4 to FIG. 6 is an explanatory views illustrating a method of use of a dispenser container comprising safety button structure according to an exemplary embodiment of the present disclosure.

Referring to FIG. 4 to FIG. 6, a dispenser container comprising safety button structure according to an exemplary embodiment of the present invention has a structure, wherein when in normal state, a pumping preventing protrusion 430 of a button member 400 is placed cornerwise to pumping guide grooves 521 which are formed on a lift limiting plate 520 of the rotation body 500, so that pressurizing the button member 400 may not be caused, and at this moment, if a user pressurizes the rotation body 500 and rotates to one direction, the pumping guide grooves 521 may be located directly below the pumping preventing protrusion 430 of the button member 400 and thereby, with the pumping member 300 pressurized, the pumping preventing protrusion 430 moves along the pumping guide grooves 521, leading the button member 400 to go up and down.

If ascent/descent of the said button member 400 leads to discharging of contents by the pumping of the pumping member 300, and when the rotation body 500 is released from being pressurized after contents are discharged, the rotation body 500, with the rotation body 500 rotated to one direction, rotates to the other direction and is restored automatically by the recoiling force of the restoring spring 600 where elastic energy is accumulated; thereby the pumping guide grooves 521 which are located directly below the pumping preventing protrusion 430 are cornerwise with the pumping preventing protrusion 430, and thus, will not perform pressuring operation of the button member 400.

As mentioned previously, the present disclosure is composed not to perform pressurization of the button member 400 in the normal state, but to perform pressurization of the button member 400 only in the condition of the rotation body 500 being rotated to one direction, so that it is possible to fundamentally prevent the button member 400 from being pressurized by children with low cognitive ability, therefore not only preventing children from taking harmful substances for body but also preventing unnecessary waste of contents.

As described above, optimal embodiments have been disclosed in the drawings and the specification. Although specific terms have been used herein, these are only intended to describe the present disclosure and are not intended to limit the meanings of the terms or to restrict the scope of the present disclosure as disclosed in the accompanying claims. Therefore, those skilled in the art will appreciate that various modifications and other equivalent embodiments are possible from the above embodiments. Accordingly, the scope of the present disclosure should be defined by the technical spirit of the accompanying claims.

What is claimed is:

1. A dispenser container comprising safety button structure comprising:

a container body containing contents;

a support body coupled to the upper part of the container body and supporting a pumping member;

the pumping member coupled to the support body and configured to discharge the contents by pumping;

a button member coupled to the upper part of the pumping member, the button member movable up and down according to the presence or absence of a user's pressurization and configured to deliver pressure to the pumping member;

a rotation body encircling the support body and coupled to the upper part of the container body so as to be rotated, thereby selectively limiting the pressurizing movement of the button member either by one side rotation or by the other side rotation; and a restoring spring fixed to one end of the support body while the other end is fixed to the rotation body, and restoring the rotation body which has been rotated to one side direction, wherein an inner side of the rotation body is equipped with a lift limiting plate that limits the movement of the button member according to the presence or absence of rotation of the rotation body, wherein the lift limiting plate comprises pumping guide grooves that guide the button member to move up and down only when the rotation body is rotated to one side direction, wherein a pumping preventing protrusion is secured on a lower end of the button member, the pumping preventing protrusion arranged on an upper end of the lift limiting plate to limit the movement of the button member, and wherein the lower end of the button member further includes a torsion preventing protrusion to prevent torsion of the button member when the button member moves up and down.

2. The dispenser container comprising safety button structure of claim 1, wherein the support body comprises a vertical guide groove, wherein the pumping preventing protrusion and the torsion preventing protrusion are inserted respectively; and wherein vertical movement of the pumping preventing protrusion and the torsion preventing protrusion is guided.

3. The dispenser container comprising safety button structure of claim 1, wherein the support body comprises a $1^{st}$ bent part so that one end of the restoring spring is inserted and fixed; and wherein the rotation body comprises a $2^{nd}$ bend part so that the other end of the restoring spring is inserted and fixed.

* * * * *